US007594845B2

(12) United States Patent
Lugg et al.

(10) Patent No.: US 7,594,845 B2
(45) Date of Patent: Sep. 29, 2009

(54) ABRASIVE ARTICLE AND METHOD OF MODIFYING THE SURFACE OF A WORKPIECE

(75) Inventors: Paul S. Lugg, Woodbury, MN (US); Timothy D. Fletcher, Lino Lakes, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 15 days.

(21) Appl. No.: 11/254,614

(22) Filed: Oct. 20, 2005

(65) Prior Publication Data

US 2007/0093181 A1 Apr. 26, 2007

(51) Int. Cl.
*B24B 1/00* (2006.01)

(52) U.S. Cl. ..... 451/41; 451/28; 451/527; 451/530; 451/533; 51/307

(58) Field of Classification Search ..... 451/41, 451/28, 527, 529, 533, 534, 539; 51/307
See application file for complete search history.

(56) References Cited

U.S. PATENT DOCUMENTS

| | | | | |
|---|---|---|---|---|
| 3,834,883 | A | 9/1974 | Klein | |
| 3,841,852 | A * | 10/1974 | Wilder et al. | 51/295 |
| 4,581,287 | A | 4/1986 | Smith et al. | |
| 5,120,387 | A | 6/1992 | De Bie | |
| 5,152,917 | A | 10/1992 | Pieper et al. | |
| 5,247,765 | A * | 9/1993 | Quintana | 451/548 |
| 5,304,223 | A | 4/1994 | Pieper et al. | |
| 5,318,604 | A | 6/1994 | Gorsuch et al. | |
| 5,435,816 | A | 7/1995 | Spurgeon et al. | |
| 5,437,754 | A | 8/1995 | Calhoun | |
| 5,454,844 | A | 10/1995 | Hibbard et al. | |
| 5,689,374 | A | 11/1997 | Xu et al. | |
| 5,692,950 | A | 12/1997 | Rutherford et al. | |
| 5,726,730 | A | 3/1998 | Crawford et al. | |
| 5,792,544 | A * | 8/1998 | Klein | 428/143 |
| 5,958,794 | A | 9/1999 | Bruxvoort et al. | |
| 6,121,143 | A | 9/2000 | Messner et al. | |
| 6,187,069 | B1 * | 2/2001 | Hoshi et al. | 51/298 |
| 6,194,317 | B1 | 2/2001 | Kaisaki et al. | |
| 6,243,520 | B1 | 6/2001 | Goldman | |
| 6,354,929 | B1 * | 3/2002 | Adefris et al. | 451/527 |

(Continued)

OTHER PUBLICATIONS

"Electronic Materials for Wafer Thinning", Minnesota Mining and Manufacturing Company, St. Paul, Minnesota, USA [on line], [retrieved from the internet on Oct. 11, 2005], <http://solutions.3m.com>, 2 pages.

(Continued)

*Primary Examiner*—Eileen P. Morgan
(74) *Attorney, Agent, or Firm*—C. Michael Geise; James A. Baker

(57) ABSTRACT

Provided is an abrasive article for lapping or polishing a workpiece comprising a three-dimensional, textured, flexible, fixed abrasive construction having a first surface and a working surface, the working surface comprising a plurality of precisely shaped abrasive composites, wherein the precisely shaped abrasive composite comprises a resin phase and a metal phase, wherein the metal phase further comprises superabrasive material. Also provided are a method of polishing or lapping a workpiece and a kit comprising a three-dimensional, textured, flexible, fixed abrasive construction and instructions for carrying out the method of polishing or lapping a workpiece.

20 Claims, 2 Drawing Sheets

U.S. PATENT DOCUMENTS

| | | | | |
|---|---|---|---|---|
| 6,394,888 | B1 * | 5/2002 | Matsumoto et al. | 451/548 |
| 6,634,929 | B1 * | 10/2003 | Visser | 451/41 |
| 6,702,650 | B2 * | 3/2004 | Adefris | 451/41 |
| 6,706,546 | B2 | 3/2004 | Yoshimura et al. | |
| 6,790,775 | B2 | 9/2004 | Fartash | |
| 7,123,015 | B2 | 10/2006 | Koste et al. | |
| 7,169,031 | B1 | 1/2007 | Fletcher et al. | |
| 2003/0022782 | A1 | 1/2003 | Uehara | |
| 2003/0227249 | A1 | 12/2003 | Mueller et al. | |
| 2004/0121563 | A1 | 6/2004 | Farnworth et al. | |
| 2004/0184737 | A1 | 9/2004 | Oono et al. | |
| 2004/0201026 | A1 | 10/2004 | Gill et al. | |
| 2004/0264185 | A1 | 12/2004 | Grotsch et al. | |
| 2005/0017313 | A1 | 1/2005 | Wan | |
| 2005/0023545 | A1 | 2/2005 | Camras et al. | |
| 2005/0032469 | A1 * | 2/2005 | Duescher | 451/548 |
| 2005/0118939 | A1 * | 6/2005 | Duescher | 451/527 |
| 2006/0091411 | A1 | 5/2006 | Ouderkirk et al. | |
| 2006/0091412 | A1 | 5/2006 | Wheatley et al. | |
| 2006/0091784 | A1 | 5/2006 | Conner et al. | |
| 2006/0091798 | A1 | 5/2006 | Ouderkirk et al. | |
| 2006/0092532 | A1 | 5/2006 | Ouderkirk et al. | |
| 2006/0094340 | A1 | 5/2006 | Ouderkirk et al. | |
| 2007/0026770 | A1 | 2/2007 | Fletcher et al. | |
| 2007/0176192 | A1 | 8/2007 | Leatherdale et al. | |

OTHER PUBLICATIONS

Rosenflanz et al., "Bulk glasses and ultrahard nanoceramics based on alumina and rare-earth oxides", Aug. 2004, Nature, vol. 430, pp. 761-764.

Richard J. Lewis, Sr.; *Hawley's Condensed Chemical Dictionary*, 12th Ed., 1993, pp. 304 and 747.

* cited by examiner

ABRASIVE ARTICLE AND METHOD OF MODIFYING THE SURFACE OF A WORKPIECE

TECHNICAL FIELD

This invention relates to an abrasive article and a method for modifying the surface of a workpiece.

BACKGROUND

Coated abrasive articles typically have a layer of abrasive grits adhered to a backing. Three-dimensional, textured, fixed abrasive articles include a plurality of abrasive particles and a binder in a pattern. When such articles are used in polishing or lapping hard workpieces such as sapphire, however, they may damage subsurface of the workpiece, often severely. Furthermore, the removal rates are often not measurable and when they are measurable they quickly drop to zero. Using such articles in combination with a conditioning particle can improve and sustain removal rate.

Conventional metal lapping plates may provide high removal rates and fine finish with low subsurface damage. Sustained removal rates, however, require substantial time and effort to recondition the metal surface. Furthermore, such plates are often heavy and rigid, making them cumbersome to manipulate and move and limiting their range of utility.

Composite resin-metal plates can lack the ability to construct and control the bearing area. Some composite structures are individually carved from composite plates with saws or drills to create channels or holes. The variety of geometric patterns and bearing areas in such plates is generally limited to those that can be created from straight lines and circles. Furthermore, concave or convex structures cannot readily be achieved. Carving a composite also requires substantial material or thickness, rendering the composite structure rigid and inflexible.

Rigid plates may be individually molded to achieve a concave or convex structure, but these rigid structures are not particularly amenable to replacement or disposal. Furthermore, the mechanical response of molded or cast plates having a substantial thickness cannot easily be changed, if at all.

SUMMARY OF INVENTION

In one aspect the present invention relates to an abrasive article for lapping or polishing a workpiece. The abrasive article comprises a three-dimensional, textured, flexible, fixed abrasive construction having a first surface and a working surface. The working surface comprises a plurality of precisely shaped abrasive composites. The precisely shaped abrasive composites comprise a resin phase and a metal phase. The metal phase further comprises a superabrasive material.

In another aspect, the present invention relates to an abrasive article comprising a three-dimensional, textured, flexible, fixed abrasive construction having a first surface and a working surface. The working surface comprises a plurality precisely shaped abrasive composites, wherein the precisely shaped abrasive composites comprise a resin phase and a metal phase. The working surface further comprises a region of superabrasive material in an erodable or soluble matrix.

In another aspect, the present invention relates to a method of polishing or lapping a workpiece. The method comprises contacting a contact surface of a workpiece and a working surface of a three-dimensional, textured, flexible, fixed abrasive construction. The working surface comprises a plurality of precisely shaped abrasive composites. The precisely shaped abrasive composites comprise a resin phase and a metal phase. The method further comprises relatively moving the workpiece and the abrasive construction while contacting the contact surface and the working surface. The method also comprises providing a superabrasive material such that the superabrasive material is provided in the metal phase.

In yet another aspect, the present invention relates to a kit. The kit comprises a three-dimensional, textured, flexible, fixed abrasive construction having a first surface and a working surface. The working surface comprises a plurality of precisely shaped abrasive composites, wherein the precisely shaped abrasive composites comprise a resin phase and a metal phase. The kit further comprises instructions for carrying out a method of polishing or lapping a workpiece. The method comprises contacting a contact surface of a workpiece and a working surface of a three-dimensional, textured, flexible, fixed abrasive construction. The working surface comprises a plurality of precisely shaped abrasive composites. The precisely shaped abrasive composites comprise a resin phase and a metal phase. The method further comprises relatively moving the workpiece and the abrasive construction while contacting the contact surface and the working surface. The method also comprises providing a superabrasive material such that the superabrasive is in the metal phase.

Other features and advantages of the invention will be apparent from the following detailed description and claims. The above summary is not intended to describe each illustrated embodiment or every implementation of the present disclosure. The figures and the detailed description that follow more particularly exemplify certain preferred embodiments utilizing the principles disclosed herein.

Throughout this disclosure, the following definitions apply:

"Modulus" refers to the elastic modulus or Young's Modulus of a material; for a resilient material it is measured using a dynamic compressive test in the thickness direction of the material, whereas for a rigid material it is measured using a static tension test in the plane of the material;

"Fixed abrasive" and "fixed abrasive construction" refer to an integral abrasive or construction, such as an abrasive article, that is substantially free of unattached abrasive particles except as may be generated during modification of the surface of a workpiece;

"Three-dimensional" when used to describe a fixed abrasive construction refers to a fixed abrasive construction, particularly a fixed abrasive article, having numerous abrasive particles extending throughout at least a portion of its thickness;

"Textured" when used to describe a fixed abrasive construction refers to a fixed abrasive element, particularly a fixed abrasive article, having raised portions and recessed portions in which at least the raised portions contain a resin phase and a metal phase;

"Abrasive composite" refers to one of a plurality of shaped bodies which collectively provide a textured, three-dimensional abrasive construction comprising a resin phase and a metal phase; and "Precisely shaped abrasive composite" refers to an abrasive composite having a molded shape that is substantially the inverse of the mold cavity which is retained after the composite has been removed from the mold.

DETAILED DESCRIPTION

In one aspect, the present description relates to an abrasive article for lapping or polishing a workpiece. The abrasive article may comprise a three-dimensional, textured, flexible, fixed abrasive construction having a first surface and a working surface. The working surface may comprise a plurality of precisely shaped abrasive composites. The precisely shaped abrasive composite may comprise a resin phase and a metal phase. The metal phase may further comprise a superabrasive material.

Figure 1:
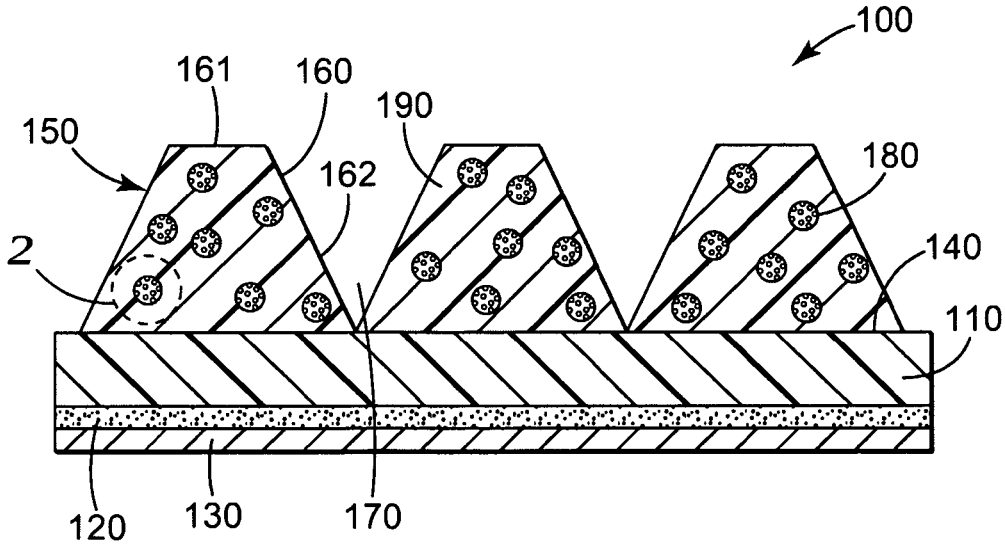
FIG. 1 is an enlarged schematic cross-sectional view of a portion of an abrasive article.

In one embodiment, shown in FIG. 1, abrasive article 100 comprises backing 110 having pressure sensitive adhesive layer 120 and protective liner 130. Over front surface 140 of backing 110 is abrasive construction 150. Abrasive construction 150 is three-dimensional (as this term is defined above) and comprises a plurality of abrasive composites 160. Abrasive composites 160 have distal surfaces 161 and lateral surfaces 162. There are openings or valleys 170 between adjacent abrasive composites 160. Openings or valleys 170 may, in some embodiments, allow slurry and/or working fluid movement during the use of abrasive article 100. Openings or valleys 170 may also, in some embodiments, facilitate the removal of swarf during the use of abrasive article 100. In this particular embodiment, abrasive composites 160 are truncated pyramids. Abrasive composites 160 comprise a plurality of discrete metal phases 180 and a continuous resin phase 190.

The abrasive composites may be arranged in an array to form the three-dimensional, textured, flexible, fixed abrasive construction. Suitable arrays include, for instance, those described in U.S. Pat. No. 5,958,794 (Bruxvoort et al.). The abrasive article may comprise abrasive constructions that are patterned. Trizact™ abrasives, made by 3M Company, are exemplary of a patterned abrasive. Patterned abrasive articles include monolithic rows of abrasive composites precisely aligned and manufactured from a die, mold, or other techniques. Such patterned abrasive articles can abrade, polish, or simultaneously abrade and polish, as described in co-pending U.S. patent application Ser. No. 10/977,239, commonly assigned with the present application. When needed to abrade, polish, or simultaneously abrade and polish, any number of tools may be used, including applying an abrasive article to at least a portion of a rotatable cylinder, a belt, or a flat sheet to create a tool.

FIG. 1 illustrates an embodiment in which the abrasive article comprises a backing, a pressure sensitive coating, and a protective liner. In other embodiments, the fixed abrasive article may have only a backing. In such an embodiment, the abrasive composites are attached to a backing. Optionally, the abrasive article does not have a separate backing. Such embodiments are known as having "integral structures". Referring to FIG. 1, integral structures might include an example wherein resin phase 190 and backing 110 are continuous and made of the same material.

The abrasive article may comprise a three-dimensional, textured, flexible, fixed abrasive construction having a first surface and a working surface. In some embodiments, the first surface may further be in contact with a backing, optionally with an adhesive interposed therebetween. Any variety of backing materials are contemplated, including both flexible backings and backings that are more rigid. Examples of flexible backings include, for instance, polymeric film, primed polymeric film, metal foil, cloth, paper, vulcanized fiber, nonwovens and treated versions thereof and combinations thereof. Examples include polymeric films of polyester, and co-polyester, micro-voided polyester, polyimide, polycarbonate, polyamide, polyvinyl alcohol, polypropylene, polyethylene, and the like. When used as a backing, the thickness of a polymeric film backing is chosen such that a desired range of flexibility is retained in the abrasive article.

In some embodiments, such as those described in FIG. 1, a backing is a rigid element that is generally coextensive with and interposed between a protective liner and the abrasive composites. By "resilient element" is meant an element that supports the rigid element, elastically deforming in compression. By "rigid element" is meant an element that is of higher modulus than the resilient element and which deforms in flexure. Such designs are particularly useful in polishing or lapping a planar workpiece contact surface and are generally described in U.S. Pat. No. 5,692,950 (Rutherford et al.).

In another aspect, the working surface may comprise a plurality of precisely shaped abrasive composites. The precisely shaped abrasive composite may comprise a resin phase and a metal phase. The shape of each precisely shaped abrasive composite may be selected for the particular application (e.g., workpiece material, working surface shape, contact surface shape, temperature, resin phase material, metal phase material). The shape of each precisely shaped abrasive composite may be any useful shape, e.g., cubic, cylindrical, prismatic, right parallelepiped, pyramidal, truncated pyramidal, conical, hemispherical, truncated conical, cross, or post-like sections with a distal end. Composite pyramids may, for instance, have three, four sides, five sides, or six sides. The cross-sectional shape of the abrasive composite at the base may differ from the cross-sectional shape at the distal end. The transition between these shapes may be smooth and continuous or may occur in discrete steps. The precisely shaped abrasive composites may also have a mixture of different shapes. The precisely shaped abrasive composites may be arranged in rows, spiral, helix, or lattice fashion, or may be randomly placed. The precisely shaped abrasive composites may be arranged in a design meant to guide fluid flow and/or facilitate swarf removal.

The lateral sides forming the precisely shaped abrasive composite may be tapered with diminishing width toward the distal end. The tapered angle may be from about 1 to less than 90 degrees, for instance, from about 1 to about 75 degrees, from about 3 to about 35 degrees, or from about 5 to about 15 degrees. The height of each precisely shaped abrasive composite is preferably the same, but it is possible to have precisely shaped abrasive composites of varying heights in a single article.

The base of the precisely shaped abrasive composites may abut one another or, alternatively, the bases of adjacent precisely shaped abrasive composites may be separated from one another by some specified distance. In some embodiments, the physical contact between adjacent abrasive composites involves no more than 33% of the vertical height dimension of each contacting precisely shaped abrasive composite. This definition of abutting also includes an arrangement where adjacent precisely shaped abrasive composites share a common land or bridge-like structure which contacts and extends between facing lateral surfaces of the precisely shaped abrasive composites. The abrasives are adjacent in the sense that no intervening composite is located on a direct imaginary line drawn between the centers of the precisely shaped abrasive composites.

The precisely shaped abrasive composites may be set out in a predetermined pattern or at a predetermined location within the abrasive article. For example, when the abrasive article is made by providing a slurry between a backing and mold, the predetermined pattern of the precisely shaped abrasive composites will correspond to the pattern of the mold. The pattern is thus reproducible from abrasive article to abrasive article.

The predetermined patterns may be in an array or arrangement, by which is meant that the composites are in a designed array such as aligned rows and columns, or alternating offset rows and columns. In another embodiment, the abrasive composites may be set out in a "random" array or pattern. By this is meant that the composites are not in a regular array of rows and columns as described above. It is understood, however, that this "random" array is a predetermined pattern in that the location of the precisely shaped abrasive composites is predetermined and corresponds to the mold.

In one aspect, the metal phase may be a continuous phase and the resin phase may be a discrete phase. In another aspect, the resin phase may be a continuous phase and the metal phase may be a discrete phase. In yet another aspect, both the resin phase and the metal phase may be continuous phases. Embodiments of the latter aspect may include, for instance, a precisely shaped resin phase. A metal phase can be provided, for instance, as a layer or a lamella which is parallel to the lateral surface of the abrasive composite, parallel to the distal surface of the abrasive composite, or both.

In some embodiments, the resin phase may include a cured or curable organic material. The method of curing is not critical, and may include, for instance, curing via energy such as UV light or heat. Examples of suitable resin phase materials include, for instance, amino resins, alkylated urea-formaldehyde resins, melamine-formaldehyde resins, and alkylated benzoguanamine-formaldehyde resins. Other resin phase materials include, for instance, acrylate resins (including acrylates and methacrylates), phenolic resins, urethane resins, and epoxy resins. Particular acrylate resins include, for instance, vinyl acrylates, acrylated epoxies, acrylated urethanes, acrylated oils, and acrylated silicones. Particular phenolic resins include, for instance, resole and novolac resins, and phenolic/latex resins. The resins may further contain conventional fillers and curing agents such as are described, for instance, in U.S. Pat. No. 5,958,794 (Bruxvoort et al.).

The precisely shaped abrasive composite also comprises a metal phase. The metal phase may also comprise a superabrasive material. The metal phase includes, for instance, relatively soft metals (relative to the hardness of the workpiece). Without wishing to be bound by theory, it is believed that in some embodiments, wherein a relatively soft metal phase comprises superabrasive material, the superabrasive material is permitted some degree of motion within the metal phase, allowing both the exposure of new superabrasive surface which promotes polishing and lapping, as well as some mechanical response to localized pressure to allow a reduction in scratching on a workpiece surface.

Figure 2:
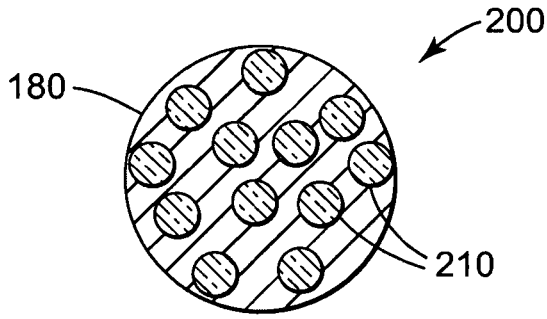
FIG. 2 is and an enlarged schematic view of a metal phase comprising superabrasive material.

FIG. 2 is and an enlarged view of a metal phase comprising superabrasive material. In this particular embodiment, metal phase 180 comprises superabrasive material 210. In FIG. 1, metal phase 180 is depicted as distributed throughout the bulk of abrasive composites 160. In other embodiments, metal phase 180 may be concentrated at the surfaces of abrasive composites 160, for instance at distal surface 161, lateral surface 162, or both.

In one aspect, suitable metals include, for instance, tin, bismuth, copper, lead, iron, silver, antimony, cadmium, and mixtures and alloys thereof. The volume percent of the metal phase in a precisely shaped abrasive composite is not particularly limited. Also, when a plurality of precisely shaped abrasive composites are present in a three-dimensional, textured, flexible, fixed abrasive construction, each precisely shaped abrasive composite need not have the same volume percent of the metal phase, although in some embodiments they have substantially the same volume percent (that is, the volume percent varies by less than 20%, less than 10%, or less than 5%).

In some embodiments, the metal phase further comprises superabrasive material. Suitable superabrasive materials include, for instance, diamond, cubic boron nitride, or combinations thereof. In one aspect, when the metal phase includes a superabrasive material, the superabrasive material may be provided by a process of mixing the metal phase and the superabrasive material prior to forming the abrasive composites comprising the metal phase. This embodiment may be considered charging during manufacture.

In another embodiment, the plurality of abrasive composites may also be formed with a resin phase and a metal phase that may or may not initially comprise superabrasive material. A slurry or mixture containing the superabrasive material may be used to charge the metal phase with superabrasive material. In yet another aspect, a plurality of abrasive composites may be formed with a resin phase and a metal phase that may or may not comprise superabrasive material. The working surface may further comprise a region of superabrasive material in an erodable or soluble matrix. The superabrasive material (in, for instance, a petroleum jelly/diamond paste), may then, for instance, in a lapping application, be dispersed (for example, by wiping or otherwise spreading across the workpiece and the working surface surfaces of the three-dimensional, textured, flexible, fixed abrasive construction) such that the metal phase becomes charged with superabrasive material during use. This embodiment may be considered in-situ charging.

Figure 3:
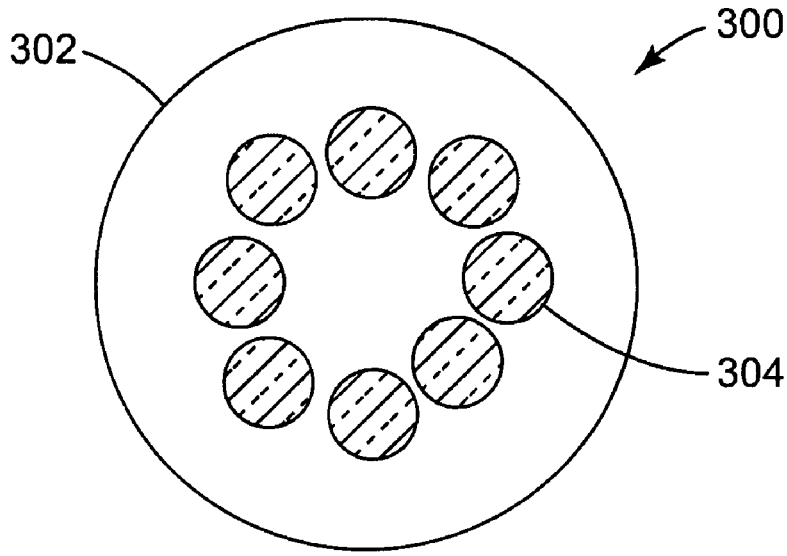
FIGS. 3 and 4 show exemplary configurations of an abrasive article with regions of superabrasive material.
Figure 4:
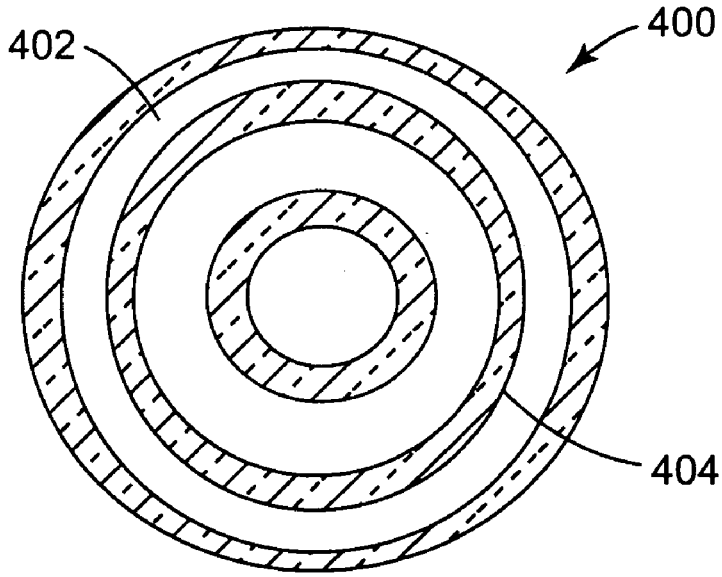

Useful configurations for achieving this providing and distribution of abrasive particles include those shown in FIGS. 3 and 4. More specifically, FIG. 3 shows abrasive article 300 with a general region or field of abrasive composites 302 and in selected regions within this field is provided regions of superabrasive material 304, shown here is a circular pattern of circles. FIG. 4 shows abrasive article 400 with a general region or field of abrasive composites 402 and in selected regions within this field are provided regions of superabrasive material 404, shown here in a co-centric circular pattern.

The abrasive articles described herein can be made by adapting conventional procedures for making precisely shaped abrasive composites. Such methods are described, for instance, in U.S. Pat. No. 5,152,917 (Pieper et al.) and U.S. Pat. No. 5,435,816 (Spurgeon et al.). Other descriptions include those found in U.S. Pat. Nos. 5,437,754, and 5,454,844 (both to Hibbard et al.), and U.S. Pat. No. 5,304,223 (Pieper et al.). Briefly, in one aspect, these methods include preparing a mixture of resin phase and metal phase and providing a mold having a front surface and having a plurality of cavities that extend from the front surface. The mixture is introduced into the cavities of the mold. Optionally, a backing is then introduced to the front surface of the mold such that the mixture wets one major surface of the backing to form an article. In some embodiments, the resin phase is partially cured or gelled before the article departs from the outer surface of the mold (which may be done, if at all, either before or after introducing the backing). The resulting article is removed from the production tool to form an abrasive construction having precisely shaped abrasive composites, optionally bonded to a backing. The resin phase may optionally be further cured after removal. Further description of representative methods of manufacturing such abrasive articles may be found in U.S. Pat. No. 5,958,794 (Bruxvoort et al.).

In one aspect, the three-dimensional, textured, fixed abrasive construction may be flexible. In some embodiments, a three-dimensional, textured, flexible, fixed abrasive is capable of being wrapped around a cylinder (e.g., a mandrel) in a convex manner (that is, with the working surface generally being convex and the first surface generally being concave). Such configurations may allow, for instance, simultaneous abrading and polishing of a workpiece. When such simultaneous abrading and polishing take place, the contact surface of the workpiece may form channels that correspond to a channel formed or shaped in the negative of the abrasive composites (as described in co-pending U.S. patent application Ser. No. 10/977,239, commonly assigned with the present application).

In some aspects, a channeled workpiece may comprise a distal surface and lateral surfaces, wherein the lateral surfaces of the channel are modified (e.g., lapped or polished) by the lateral surfaces of a precisely shaped abrasive composite within the working surface of the abrasive article. One potential advantage to such embodiments may be that the superabrasive material may be distributed on the working surface wherever the working surface is in contact with a workpiece. For instance, the superabrasive may be distributed on the distal surface, on lateral surfaces, on both, or may be distributed throughout the bulk of each precisely shaped abrasive composite.

In other embodiments, a three-dimensional, textured, flexible, fixed abrasive construction is capable of conforming to a cylindrical workpiece (that is, the working surface is concave and the first surface is convex). In such embodiments, relatively moving the workpiece and the abrasive article while contacting the contact surface and the working surface allows polishing and/or lapping of a cylindrical surface. Unlike abrasive shoes or other rigid abrasive articles, the abrasive articles of the present invention need not be manufactured in a shape that matches the shape of the workpiece. The flexible nature of the abrasive article allows it to conform to the shape of the workpiece.

In yet further embodiments, a three-dimensional, textured, flexible, fixed abrasive construction may be used in combination with a backing that is a rigid element that is generally coextensive with and interposed between a protective liner and the abrasive composites. When such a combination is used, the abrasive article may be capable of substantially conforming to the global topography of the surface of a planar or substantially planar workpiece while not substantially conforming to the local topography of the surface of the workpiece (e.g., the spacing between adjacent features on the surface of a workpiece) during surface modification (e.g., lapping or polishing). As a result, some embodiments of such abrasive articles can modify the surface of a workpiece in order to achieve a desired level of planarity, uniformity, and/or roughness. One of ordinary skill in the art, guided by this disclosure, may select the particular degree of planarity, uniformity, and/or roughness desired, depending upon the individual workpiece and the application for which it is intended, as well as the nature of any subsequent processing steps to which the workpiece may be subjected.

The flexible nature of the three-dimensional, textured, flexible, fixed abrasive construction also may allow a user to easily exchange the abrasive when it is used up, avoiding the cost and time associated with reconditioning conventional metal lapping plates and rigid composite plates. Furthermore, the abrasive articles may be used in combination with very rigid backings, depending on the specific use to which they are put. When a particular geometry is desired, the three-dimensional, textured, flexible, fixed abrasive construction may be used in conjunction with a rigid support. When a compliant support is used, however, the abrasive article may be able to conform to the existing geometry of a workpiece while refining its surface.

In some embodiments, flexible means that for a given length of abrasive article, the abrasive article is capable of flexure in the direction perpendicular to its length of up to 5%, 10%, 20%, 25%, or even up to 50% of its length.

The workpiece upon which the described abrasive articles may work is not particularly limited. In one aspect, the abrasive articles are suitable for use with hard and/or brittle workpiece materials. In some embodiments, appropriate workpiece materials may include, for instance, sapphire, c-plane sapphire, zinc oxide, silicon carbide, germanium, topaz, diamond, zirconia, calcite, gallium arsenide, gallium nitride, Aluminum Oxy Nitride (ALON), steel, chrome steel, glass, silicon, crystalline quartz, and combinations thereof. In other embodiments, appropriate workpiece materials may include, for instance, optical substrates, light emitting diodes, or semiconductor materials.

In some respects, a workpiece may have a contact surface that may be contacted with a working surface of a three-dimensional, textured, flexible, fixed abrasive construction. The flexible nature of the abrasive construction may, in some embodiments, allow the contact surface of the workpiece to be any of a number of shapes. Examples include a planar or substantially planar contact surface, a dished contact surface, a convex or concave contact surface, or any other shaped surface to which the three-dimensional, flexible, fixed abrasive construction is conformable. The flexible nature of the abrasive construction may allow it to be cut in a daisy pattern, allowing substantial conformance of the shape of the abrasive article to a curved or spherical workpiece.

The surface finish of a lapped or polished workpiece may be evaluated using a well-known quantity, Ra, which can be measured using an interferometer or a contact profilometer. When an abrasive article as described herein is used, desirable Ra values on the surface of a hard and/or brittle workpiece may be obtained. For instance, when c-plane sapphire lapping is performed, the desired Ra value may be less than 200 angstroms.

The surface finish may also be characterized by visual inspection, which may be an accurate measure of the degree of surface scratching. For instance, a surface having a high density of surface scratching will appear more opaque than a surface having a lower density of surface scratching. This contrast is similar to that between transparent and frosted glass. Workpieces finished according to the present description may also have a specularly reflective surface with substantially lower scratching levels (number and size of scratches), as compared to known processes under similar polishing conditions. Workpieces having higher scratching levels scatter a higher percentage of incident light.

In some embodiments, the abrasive articles described herein are useful in lapping or polishing operations, especially with workpieces that are hard and/or brittle. In one aspect, the inventive method may maintain a cut rate on a workpiece at a desired level for extended time periods without the need for a separate, or off-line, abrasive dressing or conditioning process. In another aspect, the abrasive articles described herein may provide an improved removal rate stability and predictability, which improves process efficiency and reduces scrap during finishing operations.

In yet another aspect, the present description relates to a method of polishing or lapping. The method comprises contacting a contact surface of a workpiece and a working surface of a three-dimensional, textured, flexible, fixed abrasive construction. The working surface may comprise a plurality of precisely shaped abrasive composites. The precisely shaped abrasive composite may include a resin phase and a metal phase. The method further comprises relatively moving the workpiece and the abrasive construction while contacting the contact surface and the working surface. In another aspect, the method comprises providing a superabrasive material such that the superabrasive material is provided in the metal phase.

In some aspects, the relatively moving while contacting the contact surface and the working surface and providing a superabrasive material may be simultaneous. Such embodiments include, for instance, when multiple abrasive composites are formed with a resin phase and a metal phase where the metal phase does not initially comprise superabrasive material. Secondary patterns may be provided in (e.g., die cutting) the three-dimensional, flexible, fixed abrasive construction (leaving cavities in the three-dimensional, flexible, fixed abrasive construction). The film may then be laminated to a backing. A mixture containing the superabrasive material (for instance, a petroleum jelly/diamond paste), may then be applied to the secondary patterns and planarized (e.g., with a squeegee). In use, for instance, in a lapping application, the superabrasive material is distributed across the surface of the three-dimensional, flexible, fixed abrasive construction such that the charging of the metal phase with superabrasive material (that is, providing the superabrasive material) takes place simultaneously with relatively moving and contacting.

In other embodiments, providing the superabrasive phase takes place before relatively moving the workpiece and the abrasive construction while contacting the contact surface and the working surface. Such embodiments may include when the superabrasive material is provided by a process of mixing the metal phase and the superabrasive material prior to forming the abrasive composites comprising the metal phase. In another aspect, such embodiments include when the abrasive composites are formed with a resin phase and a metal phase that may or may not initially comprise superabrasive material and then a slurry or mixture containing the superabrasive material is used to charge the metal phase with superabrasive material before the step of relatively moving the workpiece and the abrasive construction while contacting the contact surface and the working surface.

In yet a further aspect, the present description relates to a kit. Such a kit may comprise a three-dimensional, textured, flexible, fixed abrasive construction having a first surface and a working surface. The working surface may comprise a plurality of precisely shaped abrasive composites, wherein the precisely shaped abrasive composite comprises a resin phase and a metal phase. The metal phase may or may not comprise a superabrasive material. The kit further comprises instructions for carrying out a method as described herein.

Objects and advantages of this invention are further illustrated by the following examples, and the particular materials and amounts thereof recited in the examples, as well as other conditions and details.

EXAMPLES

Preparation of Metal-Resin Binder Precursor Slurry 1

A dispersant solution of 25 wt % dispersant (Solsperse™ 32000, available from Noveon Division, Lubrizol Ltd., Manchester, U.K.) and 75 wt % acrylate resin (SR 368 D, available from Sartomer Co., Inc., Exton, Pa.) was mixed for approximately 1 h using an air driven propeller mixer. During mixing the mixture was placed in a heated water bath (60° C.) to facilitate melting of the dispersant into the resin. Vazo 52 thermal initiator (available from Dupont Chemical Solution Enterprise, Bell, W.Va.) was crushed prior to mixing into the resin using a ceramic mortar to break up the Vazo 52 into fine particulates. A thermal initiator solution was produced by mixing 5 wt % Vazo 52 into 95 wt % acrylate resin (SR 368 D) for approximately 1 h using an air driven propeller mixer. Calcium metasilicate (NYAD M400 Wollastonite, available from NYCO Minerals Inc., Hermosillo Sonora, Mexico) was dried before use by placing the NYAD M400 into a metal container and heating the container in an oven set at 120° C. for 2-4 days. The NYAD M400 was then cooled to room temperature and the container sealed with vinyl tape until use.

A resin pre-mix was produced by mixing the following components using a high speed Cowels blade mixer: 89 wt % 368 D resin, 10 wt % dispersant solution described above, and 1 wt % photoinitiator (Irgacure 819, available from Ciba Specialty Chemicals, Tarrytown, N.Y.). The resin premix was mixed for approximately 15 minutes until the photoinitiator dissolved.

A metal resin binder precursor slurry was produced by mixing 134.5 g of resin premix described above with 231.5 g of NYAD M400, 10 g fumed silica (OX 50, available from Degussa Corporation, Parsippany, N.J.), and 91.5 g of 1-5 micron tin powder (SN-101 available from Atlantic Equipment Engineers, Bergenfield, N.J.) under high shear using an air driven high speed Cowels blade mixer for 30 minutes. To this slurry mixture 0.25 g of an antifoam (Dow Corning Additive #7, available from Dow Corning Corp.) was added. The mixture was allowed to cool to room temperature (20-25° C.). The slurry was then mixed for 15 minutes under low shear using an air driven propeller mixer, during which 32 g of the thermal initiator solution was added.

Preparation of Metal-Resin Binder Precursor Slurry 2

A dispersion of 70 g of −100 mesh tin powder (Sigma Aldrich, Milwaukee, Wis.) was combined with 30 g of resole resin (3M R23155, 75 wt % solids, 1.5:1 formaldehyde:phenolic, KOH catalyzed), and 15 ml of 50:50 isopropanol and water. This dispersion was mixed for approximately 30 minutes using an air driven propeller mixer.

Preparation of Metal-Resin Binder Precursor Slurry 3

A dispersion of 70 g of −200 mesh copper powder (Sigma Aldrich, Milwaukee, Wis.) was combined with 30 g of epoxy resin (available as Scotchweld 1838L A/B, 2 part epoxy, from 3M Company, St. Paul, Minn.). This dispersion was mixed for approximately 10 minutes using an air driven propeller mixer.

Preparation of Metal-Resin Binder Precursor Slurry 4

A dispersion of −100 mesh tin powder (Sigma Aldrich, Milwaukee, Wis.) was combined with 30 g of epoxy resin (available as Scotchweld 1838L A/B, 2 part epoxy, from 3M Company, St. Paul, Minn.). This dispersion was mixed for approximately 10 minutes using an air driven propeller mixer.

Three Dimensional, Textured, Flexible, Fixed Abrasive Construction

Preparation—Method I

Three dimensional, textured, flexible fixed abrasive composite articles were made generally as described in U.S. Pat. No. 5,958,794 (Bruxvoort, et al.). A polypropylene tool (mold) was provided comprising an array of cavities. The cavities in the tool were in the form of inverted truncated four-sided pyramids having approximate dimensions including a depth of 800 μm, an opening of 2800 μm by 2800 μm and a base of 2500 μm by 2500 μm with a center-to-center spacing of 4000 μm. The mold was essentially the inverse of the desired shape, dimensions, and arrangement of the abrasive composites.

An approximately 305 mm (12 inch)×508 mm (20 inch) piece of the polypropylene mold was adhered to a 3 mm (0.12 inch) thick aluminum plate using masking tape (commercially available from 3M Company, St. Paul, Minn.) with the mold cavities facing up (open side exposed). The metal resin binder precursor slurry (Metal-Resin Binder Precursor Slurry 1) was then spread by hand into these cavities using a rubber squeegee. Next, a polyester backing (127 μm thick (5 mil) polyester film having an ethylene acrylic acid co-polymer primer on the surface to be coated, available as Scotchpak™ from 3M Company) was contacted with the metal resin slurry-coated mold such that the abrasive slurry wet the primed surface of the backing. A bench top laminator with rubber rollers (ChemInstruments, Fairfield, Ohio) was used to facilitate the intimate contact between the metal resin slurry and the backing. The laminator was operated at an applied pneumatic pressure of 414 kPa (60 psi) over a 61 cm (24 inch) width roll. The aluminum plate with the filled metal-resin slurry coated mold and the polyester backing was then exposed to Ultraviolet (UV) light radiation by transporting the plate-mold-backing construction through a UV processor (commercially available from American Ultraviolet Company, Murry Hill, N.J.) at between 4.6-7.6 m/min (15-25 ft./min). The UV energy was transmitted through the backing into the metal resin slurry. The UV lamp used was a medium pressure mercury arc lamp operated at 157.5 watts/cm (400 watts/inch). The plate-mold-backing construction was passed through the UV lights twice at between 4.6-7.6 m/min (15-25 ft./min) with the polyester backing facing the UV lights. The polypropylene mold (with the partially cured metal-resin slurry and the polyester backing) was then removed from the aluminum plate, flipped over so that the polypropylene mold was facing up and placed back onto the aluminum plate. An approximately 1 cm (0.4 inch) quartz plate was placed on top of the polypropylene mold to keep it flat while it was sent through the UV processor for one pass at between 4.6-7.6 m/min (15-25 ft./min) during which the polypropylene mold was facing the UV lights.

Upon exposure to UV radiation, the metal-resin binder precursors were converted into three dimensional, textured, flexible fixed abrasive metal-resin composites. The mold was removed from the abrasive composite/backing. The metal-resin abrasive composites were then heated for 1 h in an oven set at 80 to 105° C. to complete the cure of the binder system and to activate the primer on the polyester backing.

To prepare the abrasive article for testing, abrasive composite/backing sheets were laminated to a 0.762 mm (0.030 inch) thick polycarbonate sheet (Lexan™ 8010MC, available from GE Polymer Shapes, Mount Vernon, Ind.) using a pressure sensitive adhesive tape (442 DL, available from 3M, St. Paul, Minn.). A 30.48 cm (12 inch) diameter circular test sample was die cut for testing.

Preparation—Method II

An approximately 305 mm (12 inch)×508 mm (20 inch) piece of the polypropylene mold was adhered to a 3 mm (0.12 inch) thick aluminum plate using masking tape (commercially available from 3M Company, St. Paul, Minn.) with the mold cavities facing up (open side exposed). The metal resin binder precursor slurry (Resin Binder Precursor Slurry 2) was then spread by hand into these cavities using a rubber squeegee. The aluminum plate and filled mold was permitted to dry for 10 minutes at room temperature and then cured in a circulating air oven at 60° C. for 1 h, 85° C. for 1 h, 105° C. for 1 h and 120° C. for 1 h. The plate and mold was than cooled to room temperature. Approximately 100 g of mixed Scotch-weld 1838L A/B epoxy resin was applied as a puddle on top of the metal/resin and mold. A sheet of Scotchpak™ (3M Company) was applied over the tooling and epoxy resin. A sheet of glass was then placed over the Scotchpak film causing the epoxy resin to flow over the metal/resin material and become planar. The laminate was left undisturbed for 15 h. After the epoxy resin hardened the mold was removed and the composite article was heated for 2 h at 70° C. This composite article was then die cut into a 12 inch circle. Eight additional 5 cm circles were die cut near the center of the 12 inch article. The 8 holes formed a circle with each hole about 2 inches from the perimeter of the 12 inch article, as shown in FIG. 3. To prepare the abrasive article for testing, abrasive composite/backing sheets were laminated to 12 inch diameter, 0.762 mm (0.030 inch) thick polycarbonate sheet (Lexan™ 8010MC, available from GE Polymer Shapes, Mount Vernon, Ind.) using a pressure sensitive adhesive tape (442 DL, available from 3M, St. Paul, Minn.).

Preparation—Method III

An approximately 305 mm (12 inch)×508 mm (20 inch) piece of the polypropylene mold was adhered to a 3 mm (0.12 inch) thick aluminum plate using masking tape (Commercially available from 3M Company, St. Paul, Minn.) with the mold cavities facing up (open side exposed). The metal resin binder precursor slurry (Resin Binder Precursor Slurry 3) was then spread by hand into these cavities using a rubber squeegee. Additional resin material was then applied as a bead along one edge of the mold. A sheet of Scotchpak™ was applied over the resin and mold and the construction was pressed with rubber rollers as described in Preparation—Method I. The construction was allowed to cure for 15 h at room temperature. The laminate was left undisturbed for 15 h. After the epoxy resin hardened the mold was removed and the composite article was heated for 2 h at 70° C. To prepare the abrasive article for testing, abrasive composite/backing sheets were laminated to a 0.762 mm (0.030 inch) thick polycarbonate sheet (Lexan™ 8010MC, available from GE Polymer Shapes, Mount Vernon, Ind.) using a pressure sensitive adhesive tape (442 DL, available from 3M, St. Paul, Minn.). A 30.48 cm (12 inch) diameter circular test sample was die cut for testing.

Preparation—Method IV

An approximately 305 mm (12 inch)×508 mm (20 inch) piece of the polypropylene mold was adhered to a 3 mm (0.12 inch) thick aluminum plate using masking tape (commercially available from 3M Company) with the mold cavities facing up (open side exposed). The metal resin binder precursor slurry (Resin Binder Precursor Slurry 4) was then spread by hand into these cavities using a rubber squeegee. Additional resin material was then applied as a bead along one edge of the mold. A sheet of Scotchpak™ was applied over the resin and mold and the construction was pressed with rubber rollers as described in Preparation—Method I. The construction was allowed to cure for 15 h at room temperature. The laminate was left undisturbed for 15 h. After the epoxy resin hardened the mold was removed and the composite article was heated for 2 h at 70° C. To prepare the abrasive article for testing, abrasive composite/backing sheets were laminated to a 0.762 mm (0.030 inch) thick polycarbonate sheet (Lexan™ 8010MC, available from GE Polymer Shapes) using a pressure sensitive adhesive tape (442 DL, available from 3M Company). A 30.48 cm (12 inch) diameter circular test sample was die cut for testing. These 12 inch diameter articles were further modified by applying a 1 cm wide bead of mixed DP-100 epoxy (3M Company) creating three concentric circles that were planarized with a rubber squeegee, as shown in FIG. 4. The epoxy was allowed to cure for 1 h. The three concentric rings were 6 cm apart with the outer most ring located at the perimeter of the 12 inch diameter article.

Single Sided Lapping Test

Dress

Tests were performed on a 6DC single side lapping machine available from Strasbaugh (San Luis Obispo, Calif.). A metal resin abrasive composite pad was mounted to the platen using a pressure sensitive adhesive. The metal resin abrasive composite pads were prepared for testing by initial conditioning using alumina fixed abrasive (268 XA-A35, available from 3M Company). The 268 XA alumina fixed abrasive was mounted to three, 65 mm (2.56 inch) diameter× 3.18 mm (0.125 in.) thick Borofloat™ glass disks (Swift Glass, Elmira, N.Y.). The three Borofloat™ disks with the 268 XA abrasive on their surface were mounted to a 152 mm (6 inch) diameter×15 mm (0.6 inch) thick aluminum metal plate using mounting wax (Crystalbond 509 Clear, Aremco Products, Inc., Valley Cottage, N.Y.) to form a conditioning plate. The conditioning plate was attached to the upper head of the lapping machine and was run at an applied pressure of 20.7 kPa (3 psi) for 1 minute using a 180 rpm platen and a counter rotating 100 rpm conditioning plate. During conditioning, 10 vol % Sabrelube 9016 (Chemetall Oakite, Lake Bluff, Ill.) in deionized water was supplied at a flow rate of 30 mL/min.

Lap

The lapping fluid was prepared by mixing the lapping vehicle (V170 Water Based Vehicle available from Speedfam-Peter Wolters, Des Plaines Ill.) with DI water (1:1 ratio by wt.) with a high shear air mixer. After 10 minutes of mixing 4-8 μm polycrystalline diamond (TCD-PD, size 4-8, available from Tomei Corporation of America, Cedar Park, Tex.) was added at a ratio of 0.2 g diamond: 100 grams V170-$H_2O$ mixture. The diamond slurry was mixed for 10 minutes. A series of 10 minute lapping tests were performed on C-plane sapphire (Crystal Systems, Salem, Mass.) with the platen (304 mm (12 inch)) speed set at 180 rpm and the substrate speed (three 50 mm parts) set at 100 rpm rotating in the opposite direction to that of the platen. The lapping fluid was supplied to the pad surface at a flow rate of 6 ml/min. During the lapping test the lapping fluid was continuously stirred using a magnetic stir bar. After each test the removal rate was determined through weight loss measurements of the sapphire substrates. The removal rate of the sapphire work pieces was calculated by converting the weight loss during lapping (M in grams) to thickness removed (T in μm) by using the following equation:

$$T=10{,}000*M/(A*D)$$

where A=area of the substrate ($cm^2$) and D=density of the substrate ($g/cm^3$), and sapphire had a density of 3.9 $g/cm^3$. The surface finish of the sapphire work pieces was measured after the last lapping test for each pad by using a Tencor P2 contact profilometer available from KLA Tencor 5 (Milpitas, Calif.). The profilometer had a 0.2 μm stylus tip radius. The data reported is an average of four 0.25 mm scans taken at 90 degrees from each other at the mid radius of the 50 mm parts. The scan speed was 0.005 mm/sec with a sampling rate of 100 Hz and a horizontal resolution of 0.05 microns with an 8 micron long wavelength cut off.

Examples 1-6

The compositions used for Examples 1-6 are shown in Table I.

TABLE I

Compositions for Examples 1-6

| Component | EXAMPLE 1 | 2 | 3 | 4 | 5 | 6 |
|---|---|---|---|---|---|---|
| Acrylate resin | 119.6 | 107.0 | 119.6 | 107.0 | 119.6 | 119.6 |
| Dispersant Solution | 13.3 | 13.9 | 13.3 | 13.9 | 13.3 | 13.3 |
| Photoinitator | 1.60 | 1.45 | 1.60 | 1.45 | 1.60 | 1.60 |
| Calcium Metasilicate | 231.5 | 236.0 | 284.8 | 52 | 231.5 | 231.5 |
| Fumed silica | 10.0 | 10.0 | 10.0 | 7.5 | 10.0 | 10.0 |
| Antifoam | 0.25 | 0.25 | 0.25 | 0.25 | 0.25 | 0.25 |
| Thermal Initiator Solution | 32.0 | 29.0 | 32.0 | 29.0 | 32.0 | 32.0 |
| Tin Powder 1-5 micron | 91.5 | — | 38.3 | 289.0 | — | — |
| Tin Powder—325 mesh | — | — | — | — | 91.5 | — |
| Tin Powder—100 mesh | — | — | — | — | — | 91.5 |
| Cu Powder—200 mesh | — | 102.5 | — | — | — | — |

Example 1

A metal-resin abrasive composite pad was produced using Preparation—Method I, above; and tested according to the Single Sided Lapping Test, above. The metal-resin abrasive composite pad of this example contained 5 vol % of 1-5 μm tin powder. The resulting removal rate data is shown in Table II. The surface finish of the sapphire workpieces, Ra, was 114 angstroms. Visual inspection of the workpiece showed excellent specular reflectance and clarity.

TABLE II

Single Sided Lapping Results for Example 1

| Applied Pressure—kPa (psi) | Cumulative Time (min) | Removal Rate (μm/min) |
|---|---|---|
| 54.5 (7.9) | 10 | 2.6 |
| | 20 | 2.8 |
| 42.7 (6.2) | 30 | 2.4 |
| | 40 | 2.1 |
| | 50 | 1.9 |
| | 60 | 1.9 |
| | 70 | 2.1 |
| | 80 | 2.4 |
| | 90 | 2.2 |
| | 100 | 2.1 |
| | 110 | 2.1 |
| | 120 | 2.2 |
| | 130 | 1.8 |
| | 140 | 2.1 |
| | 150 | 2.0 |
| | 160 | 2.2 |
| | 170 | 2.5 |
| | 180 | 2.3 |

TABLE II-continued

| Single Sided Lapping Results for Example 1 | | |
|---|---|---|
| Applied Pressure—kPa (psi) | Cumulative Time (min) | Removal Rate (μm/min) |
| | 190 | 2.2 |
| | 200 | 2.1 |
| | 210 | 2.3 |

Example 2

A metal-resin abrasive pad was produced using Cu powder (−200 mesh, Sigma Aldrich, St. Louis, Mo.) and the Preparation—Method I described above. The exact composition is shown in Table I. A single sided Lapping Test on C-plane sapphire was conducted with the results being shown in Table III. The surface finish, Ra, was 200 angstroms. Visual inspection of the workpiece showed excellent specular reflectance and clarity.

TABLE III

| Single Sided Lapping Results for Example 2 | | |
|---|---|---|
| Applied Pressure—kPa (psi) | Cumulative Time (min) | Removal Rate (microns/min) |
| 35.9 (5.2) | 10 | 1.4 |
| 42.7 (6.2) | 20 | 1.9 |
| | 30 | 2.0 |
| | 40 | 1.9 |
| | 50 | 1.9 |

Example 3

A metal-resin abrasive composite pad containing 2 volume % of 1-5 μm tin powder was produced using the Preparation—Method I described above. The exact composition is shown in Table I. A Single Sided Lapping Test on C-plane sapphire with the results being shown in Table IV. The surface finish, Ra, was 181 angstroms. Visual inspection of the workpiece showed excellent specular reflectance and clarity.

TABLE IV

| Single Sided Lapping Results for Example 3 | | |
|---|---|---|
| Applied Pressure—kPa (psi) | Cumulative Time (min) | Removal Rate (microns/min) |
| 42.7 (6.2) | 10 | 0.2 |
| | 20 | 1.9 |
| | 30 | 2.1 |
| | 40 | 3.1 |
| | 50 | 2.8 |
| | 60 | 2.7 |
| | 70 | 2.8 |
| | 80 | 2.9 |
| | 90 | 2.6 |
| | 100 | 2.6 |
| | 110 | 2.8 |
| | 120 | 2.8 |

Example 4

A metal-resin abrasive composite pad containing 20 volume % of 1-5 μm tin powder was produced using the Preparation—Method I described above. The exact composition is shown in Table I. Single Sided Lapping Test on C-plane sapphire was conducted with the results being shown in Table V The finish surface, Ra, was 160 angstroms. Visual inspection of the workpiece showed excellent specular reflectance and clarity.

TABLE V

| Single Sided Lapping Results for Example 4 | | |
|---|---|---|
| Applied Pressure—kPa (psi) | Cumulative Time (min) | Removal Rate (microns/min) |
| 42.7 (6.2) | 10 | 1.7 |
| | 20 | 1.8 |
| | 30 | 1.7 |
| | 40 | 1.7 |
| | 50 | 1.7 |
| | 60 | 1.7 |
| | 70 | 1.7 |
| | 80 | 2.5 |
| | 90 | 2.0 |
| | 100 | 2.1 |
| | 110 | 2.2 |
| | 120 | 2.6 |
| | 130 | 2.2 |
| | 140 | 2.7 |
| | 150 | 2.1 |
| | 160 | 2.4 |
| | 170 | 2.3 |
| | 180 | 2.7 |

Example 5

A metal-resin abrasive composite pad containing 5 volume % of −325 mesh (44 μm) Tin powder (Sigma Aldrich, St. Louis, Mo.) was produced using the Preparation—Method I described above. The exact composition is shown in Table I. A Single Sided Lapping Test on C-plane sapphire was conducted with the results being shown in Table VI. The surface finish, Ra, was 168 angstroms. Visual inspection of the workpiece showed excellent specular reflectance and clarity.

TABLE VI

| Single Sided Lapping Results for Example 5 | | |
|---|---|---|
| Applied Pressure—kPa (psi) | Cumulative Time (min) | Removal Rate (microns/min) |
| 42.7 (6.2) | 10 | 0.3 |
| | 20 | 2.2 |
| | 30 | 2.7 |
| | 40 | 2.5 |
| | 50 | 2.6 |
| | 60 | 2.7 |

Example 6

A metal-resin abrasive composite pad containing 5 volume % of −100 mesh (149 μm) Tin Powder (Sigma Aldrich, St. Louis, Mo.) was produced using the Preparation—Method I described above. The exact composition is shown in Table I. A Single Sided Lapping Test on C-plane sapphire was conducted with the results being shown in Table VII. The surface finish, Ra, was 156 angstroms. Visual inspection of the workpiece showed excellent specular reflectance and clarity.

TABLE VII

Single Sided Lapping Results for Example 6

| Applied Pressure—kPa (psi) | Cumulative Time (min) | Removal Rate (microns/min) |
|---|---|---|
| 42.7 (6.2) | 10 | 1.9 |
| | 20 | 2.4 |
| | 30 | 2.7 |
| | 40 | 2.7 |
| | 50 | 2.7 |
| | 60 | 2.9 |
| | 70 | 2.3 |
| | 80 | 2.8 |
| | 90 | 3.0 |
| | 100 | 2.9 |
| | 110 | 2.9 |
| | 120 | 2.8 |

Example 7

A metal-resin abrasive composite pad was produced using Preparation—Method II and tested according to a modified single Sided Lapping Test. After dressing the article the 5 cm spaces were filed with a dispersion of petroleum jelly, (EM Science, Gibbstown, N.J.) containg 0.5 wt % of 9 micron monocrystalline diamond, (Tomeri Corporation of America, Cedar Park, Tex.) and planarized with a rubber squeegee. The holes were filled with additional petrolatum/diamond dispersion after 15 minutes of lapping. The resulting removal rate data is shown in Table VIII. Visual inspection of the workpiece showed excellent specular reflectance and clarity.

TABLE VIII

Single Sided Lapping Results for Example 7

| Applied Pressure—kPa (psi) | Cumulative time (min) | Removal Rate (microns/min) |
|---|---|---|
| 42.7 (6.2) | 5 | 0.2 |
| | 10 | 0.5 |
| | 15 | 1.7 |
| | 20 | 1.5 |
| | 25 | 1.7 |
| | 30 | 1.3 |
| | 35 | 0.8 |

Example 8

A metal-resin abrasive composite pad was produced using Preparation—Method III and tested according to a modified Single Sided Lapping Test. Lapping times were at 5 minute intervals up to 20 minutes. The resulting removal rate data is shown in Table IX. Visual inspection of the workpiece showed excellent specular reflectance and clarity.

TABLE IX

Single Sided Lapping Results for Example 8

| Applied Pressure—kPa (psi) | Cumulative time (min) | Removal Rate (microns/min) |
|---|---|---|
| 42.7 (6.2) | 5 | 1.0 |
| | 10 | 1.2 |
| | 15 | 0.6 |
| | 20 | 0.7 |

What is claimed is:

1. A flexible abrasive article for lapping or polishing a workpiece comprising:

a three-dimensional, textured, flexible, fixed abrasive construction having a first surface and a working surface, the working surface comprising a plurality of precisely shaped abrasive composites, wherein the precisely shaped abrasive composites comprise a resin phase and a metal phase, wherein the metal phase further comprises metal in elemental form and superabrasive material, further wherein the metal phase is concentrated at a surface of the abrasive composites.

2. The abrasive article of claim 1 wherein the resin phase is a continuous phase and the metal phase is a discrete phase.

3. The abrasive article of claim 1 wherein the metal phase is a continuous phase and the resin phase is a discrete phase.

4. The abrasive article of claim 1 wherein the precisely shaped abrasive composite is adapted to conform to workpiece features.

5. The abrasive article of claim 1 wherein the resin phase is selected from an acrylate resin, a phenolic resin, an epoxy resin, and combinations thereof.

6. The abrasive article of claim 1 wherein the metal phase comprises lead, iron, tin, silver, antimony, copper, cadmium, bismuth, and mixtures and alloys thereof.

7. The abrasive article of claim 1 wherein the metal phase comprises 1 to 99% by volume relative to the total volume of the resin phase and metal phase.

8. The abrasive article of claim 1 wherein the superabrasive material comprises diamond, cubic boron nitride, or a combination thereof.

9. The abrasive article of claim 1 further comprising a backing material attached to the first surface.

10. The abrasive article of claim 9 wherein the backing material is a flexible backing material.

11. The abrasive article of claim 10 wherein the flexible backing material is a polymeric film.

12. The abrasive article of claim 1 further comprising an adhesive suitable for attaching the abrasive article to a polishing machine portion, optionally wherein the adhesive is a pressure sensitive adhesive.

13. A flexible abrasive article comprising: a three-dimensional, textured, flexible, fixed abrasive having a first surface and a working surface, the working surface comprising a plurality of precisely shaped abrasive composites, wherein the precisely shaped abrasive composites comprise a resin phase and a metal phase, wherein the metal phase that comprises metal in elemental form and a superabrasive material is concentrated at a surface of the abrasive composites, and further wherein the working surface further comprises a region of superabrasive material in an erodable or soluble matrix.

14. A method of polishing or lapping a workpiece comprising:

contacting a contact surface of a workpiece with a flexible abrasive article having a working surface of a three-dimensional, textured, flexible, fixed abrasive construction, the working surface comprising a plurality of precisely shaped abrasive composites, wherein the precisely shaped abrasive composite comprises a resin phase and a metal phase, further wherein the metal phase comprises metal in elemental form and superabrasive material, and the metal phase is concentrated at a surface of the abrasive composites;

relatively moving the workpiece and the abrasive construction while contacting the contact surface and the.

15. The method of claim 14 wherein the relatively moving while contacting the contact surface and the working surface and providing a superabrasive material are simultaneous.

16. The method of claim 14 wherein providing a superabrasive material comprises charging the precisely shaped flexible abrasive article with a slurry containing the superabrasive material.

17. The method of claim 14 wherein providing a superabrasive material comprises providing a region of superabrasive material distributed on the working surface of the precisely shaped flexible abrasive article.

18. The method of claim 14 wherein the contact surface of the workpiece is a non-planar surface.

19. The method of claim 14 wherein the workpiece is selected from sapphire, c-plane sapphire, zinc oxide, silicon carbide, germanium, topaz, gallium arsenide, gallium nitride, Aluminum Oxy Nitride, steel, chrome steel, glass, silicon, crystalline quartz, and combinations thereof.

20. The method of claim 14, further comprising instructions for carrying out said method.

* * * * *

UNITED STATES PATENT AND TRADEMARK OFFICE

CERTIFICATE OF CORRECTION

PATENT NO. : 7,594,845 B2
APPLICATION NO. : 11/254614
DATED : September 29, 2009
INVENTOR(S) : Paul S. Lugg et al.

It is certified that error appears in the above-identified patent and that said Letters Patent is hereby corrected as shown below:

Column 12
Line 4, delete “than” and insert --then--

Column 13
Line 63, after “Tencor” delete “5”

Column 15
Line 14, after “abrasive” insert --composite--

Column 16
Line 4, delete “finish surface” and insert --surface finish--

Column 17
Line 25, delete “filed” and insert --filled--
Line 27, delete “Tomeri” and insert --Tomei--

Column 18
Line 67, delete “the.” and insert --the working surface.--

Signed and Sealed this
Twenty-second Day of March, 2011

David J. Kappos

David J. Kappos
*Director of the United States Patent and Trademark Office*